US012686969B2

(12) United States Patent
Horiko

(10) Patent No.: US 12,686,969 B2
(45) Date of Patent: Jul. 21, 2026

(54) SHEET MANUFACTURING APPARATUS

(71) Applicant: SEIKO EPSON CORPORATION, Tokyo (JP)

(72) Inventor: Yukihiro Horiko, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 18/513,699

(22) Filed: Nov. 20, 2023

(65) Prior Publication Data

US 2024/0167223 A1 May 23, 2024

(30) Foreign Application Priority Data

Nov. 21, 2022 (JP) ..... 2022-185565

(51) Int. Cl.

| | |
|---|---|
| ***D21B 1/34*** | (2006.01) |
| ***D21B 1/06*** | (2006.01) |
| ***D21B 1/10*** | (2006.01) |
| ***D21F 9/00*** | (2006.01) |
| ***D21H 27/00*** | (2006.01) |

(52) U.S. Cl.

CPC ..... *D21B 1/347* (2013.01); *D21B 1/06* (2013.01); *D21B 1/10* (2013.01); *D21F 9/00* (2013.01); *D21H 5/26* (2013.01); *D21H 5/2628* (2013.01)

(58) Field of Classification Search

CPC .. D21B 1/347; D21B 1/10; D21B 1/06; D21F 9/00; D21H 5/2628; D21H 5/26

See application file for complete search history.

(56) References Cited

U.S. PATENT DOCUMENTS

| | | | | |
|---|---|---|---|---|
| 2019/0030750 | A1* | 1/2019 | Miyasaka | D21F 9/00 |
| 2019/0381690 | A1* | 12/2019 | Watabe | D04H 1/732 |
| 2020/0399825 | A1* | 12/2020 | Motohashi | D21B 1/10 |
| 2021/0355604 | A1 | 11/2021 | Gomi et al. | |
| 2022/0034030 | A1* | 2/2022 | Miyasaka | B02C 18/2225 |
| 2025/0027240 | A1* | 1/2025 | Matsuda | D04H 1/732 |
| 2025/0092603 | A1* | 3/2025 | Sakurada | D21F 9/00 |
| 2025/0109552 | A1* | 4/2025 | Nagai | D21F 3/04 |
| 2025/0109553 | A1* | 4/2025 | Nagai | D21F 9/00 |
| 2025/0137198 | A1* | 5/2025 | Yamaya | D21F 9/00 |
| 2025/0154720 | A1* | 5/2025 | Sakurada | D21B 1/08 |
| 2025/0171962 | A1* | 5/2025 | Yamada | D21F 9/00 |
| 2025/0369186 | A1* | 12/2025 | Hamashima | D21B 1/06 |
| 2026/0009183 | A1* | 1/2026 | Yanagawa | D21G 7/00 |

FOREIGN PATENT DOCUMENTS

| | | |
|---|---|---|
| JP | 2017-065225 A | 4/2017 |
| JP | 2021-178703 A | 11/2021 |

* cited by examiner

*Primary Examiner* — Anthony Calandra
(74) *Attorney, Agent, or Firm* — Spencer Fane LLP

(57) ABSTRACT

A sheet manufacturing apparatus 1 includes a quantitative feeder unit 15 that measures a predetermined amount of a raw material C and feeds the measured raw material C, a defibration unit 31 that defibrates the raw material C fed from the quantitative feeder unit 15 into fibers, a third unit group 103 that deposits and compresses the fibers and forms the fibers into a sheet, a first frame F1 to which the quantitative feeder unit 15 is fixed, and a second frame F2 that is separated from the first frame F1 and to which the defibration unit 31 is fixed.

2 Claims, 3 Drawing Sheets

SHEET MANUFACTURING APPARATUS

The present application is based on, and claims priority from JP Application Serial Number 2022-185565, filed Nov. 21, 2022, the disclosure of which is hereby incorporated by reference herein in its entirety.

BACKGROUND

1. Technical Field

The present disclosure relates to a sheet manufacturing apparatus.

2. Related Art

A sheet manufacturing apparatus that defibrates slips of paper containing fibers or the like and recycles the paper pieces into sheets or the like is known. Some devices have a measuring unit that measures the mass of a raw material, such as slips of paper. For example, JP-A-2021-178703 discloses a fiber structure manufacturing apparatus including a quantitative feeder that measures and feeds the raw material of sheets and a dry defibrator.

However, the device described in JP-A-2021-178703 has a problem in that the measurement accuracy of the quantitative feeder cannot be easily improved. Specifically, the vibration of the dry defibrator easily propagates to the quantitative feeder, and the vibration sometimes affects the measurement accuracy of the quantitative feeder. Accordingly, there is a need for a sheet manufacturing apparatus that improves the measurement accuracy for a raw material.

SUMMARY

A sheet manufacturing apparatus includes: a quantitative feeder unit that measures a predetermined amount of a raw material and feeds the measured raw material; a defibration unit defibrating the raw material fed from the quantitative feeder unit into fibers; a sheet forming unit that deposits and compresses the fibers and forms the fibers into a sheet; a first frame to which the quantitative feeder unit is fixed; and a second frame that is separated from the first frame and to which the defibration unit is fixed.

DESCRIPTION OF EMBODIMENTS

Figure 1:
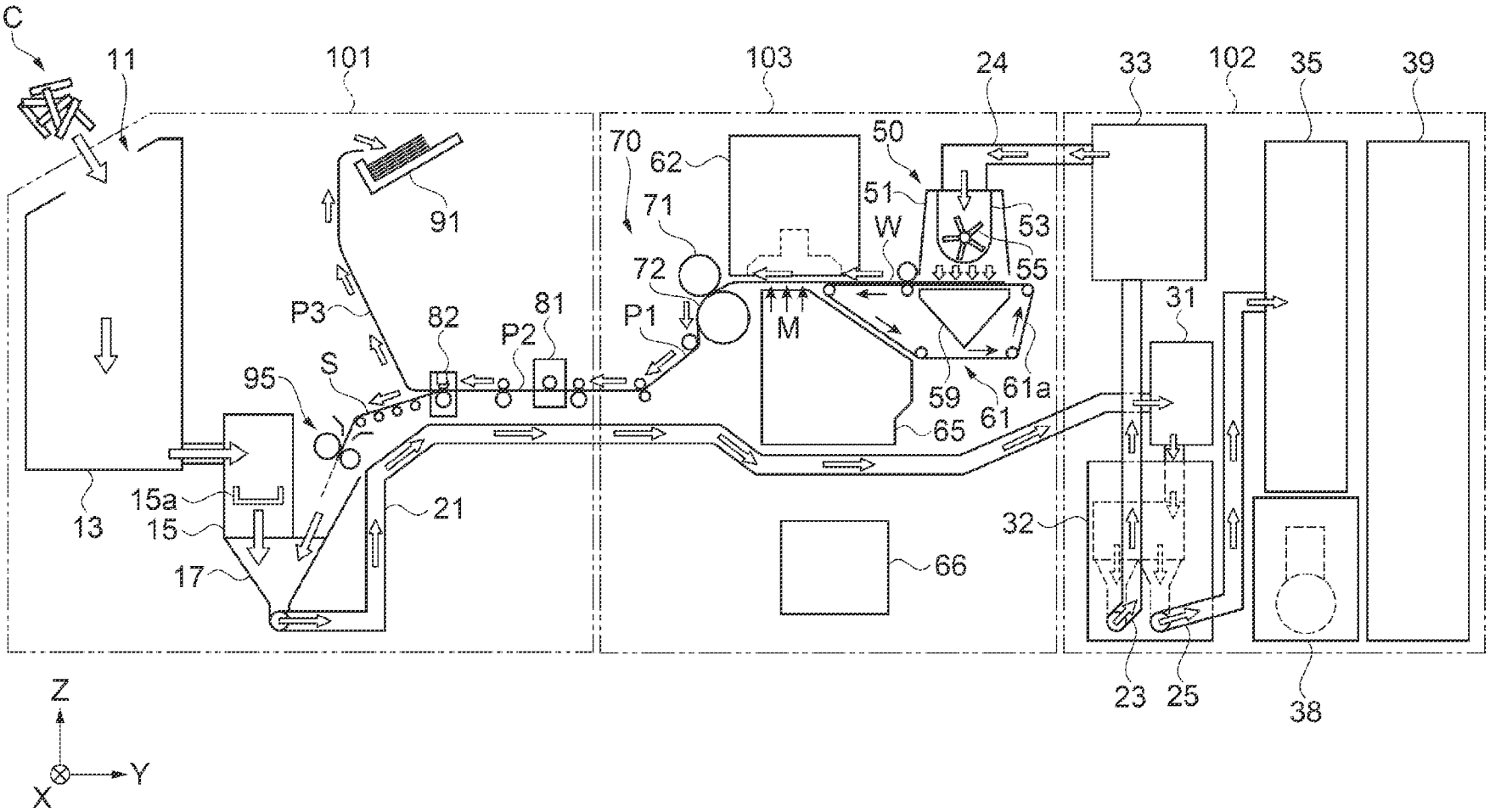
FIG. 1 is a schematic diagram illustrating the structure of a sheet manufacturing apparatus according to an embodiment.

In the embodiment described below, a sheet manufacturing apparatus 1 that recycles slips of used paper or the like in a dry process is illustrated, and the sheet manufacturing apparatus 1 will be described with reference to the drawings. The process of the sheet manufacturing apparatus according to the present disclosure is not limited to a dry process and may be a wet process. It should be noted that, in this specification, the term "dry process" refers to a process performed in air, such as atmospheric air, rather than in a liquid.

In the drawings illustrated below, X-, Y-, and Z-axes are used as coordinate axes orthogonal to each other, and the direction indicated by each arrow is the + direction, and the direction opposite to the + direction is the − direction. The Z-axis is a virtual axis parallel to the vertical direction, and the +Z and −Z directions are the upward and downward directions, respectively. The −Z direction is the direction in which gravity acts. In addition, in the sheet manufacturing apparatus 1, the direction in which a raw material, a web, and a sheet are transported is often referred to as a downstream direction, and the direction opposite to the downstream direction is often referred to as the upstream direction. For convenience of illustration, the sizes of individual members differ from the actual sizes thereof.

As illustrated in FIG. 1, the sheet manufacturing apparatus 1 according to the embodiment includes a first unit group 101, a second unit group 102, and a third unit group 103. The sheet manufacturing apparatus 1 further includes a control unit that comprehensively controls the operations of a first frame, a second frame, a third frame, and individual components, which are not illustrated. The first frame, the second frame, and the third frame will be described later. It should be noted that, in FIG. 1, the directions in which the raw material C, a sheet P3, a slit piece S, offcuts, and the like move are indicated by white arrows.

The sheet manufacturing apparatus 1 manufactures the sheet P3 from the raw material C. In the sheet manufacturing apparatus 1, the first unit group 101, the third unit group 103, and the second unit group 102 are disposed in the +Y direction in side view in the −X direction.

The raw material C is transported from the first unit group 101 to the second unit group 102 via a pipe 21 that passes through the inside of the third unit group 103. Then, the raw material C is subjected to defibration and the like by the second unit group 102 and transported to the third unit group 103 via the pipe 24. The raw material C is formed into a web W by the third unit group 103 and formed into a belt-like sheet P1. The belt-like sheet P1 is cut by the first unit group 101 into the sheet P3.

The first unit group 101 includes a buffer tank 13, a quantitative feeder unit 15, a confluence portion 17, and the pipe 21. In the first unit group 101, these components are disposed in this order from upstream to downstream. The first unit group 101 further includes a first cutting unit 81, a second cutting unit 82, a tray 91, and a shredding unit 95. The first cutting unit 81 and the second cutting unit 82 cut the belt-like sheet P1 into the sheet P3 having a predetermined shape.

The raw material C is input into the buffer tank 13 through the raw material input port 11. The raw material C contains fibers, such as cellulose, and is, for example, a shredded slip of used paper. A second humidification unit 66 of the third unit group 103 supplies humidified air into the buffer tank 13.

The raw material C is temporarily stored in the buffer tank 13 and transported to the quantitative feeder unit 15 in accordance with the operation of the sheet manufacturing apparatus 1. The sheet manufacturing apparatus 1 may have, upstream of the buffer tank 13, a shredder that shreds used paper or the like.

The quantitative feeder unit 15 includes a measuring unit 15*a* and a feeding mechanism, which is not illustrated. The measuring unit 15*a* measures the mass of the raw material C. The feeding mechanism feeds the raw material C measured by the measuring unit 15*a* to the confluence portion 17 located downstream. That is, in the quantitative feeder unit 15, the measuring unit 15*a* measures a predetermined mass of the raw material C, and the feeding mechanism feeds the measured raw material C to the confluence portion 17 located downstream.

The measuring unit 15*a* may be any type of digital or analog measuring mechanism. Specifically, the measuring unit 15*a* may be a physical sensor, such as a load cell, a spring balance, a simple balance, and the like. In the embodiment, a load cell is used as the measuring unit 15*a*. The predetermined mass of the raw material C measured by the measuring unit 15*a* is, for example, approximately several grams to several tens of grams.

A known technology, such as a vibratory feeder, is applicable to the feeding mechanism. The feeding mechanism may be included in the measuring unit 15*a*.

Measuring and feeding of the raw material C by the quantitative feeder unit 15 is performed by a batch process. That is, the raw material C is intermittently fed from the quantitative feeder unit 15 to the confluence portion 17. The quantitative feeder unit 15 may include a plurality of measuring units 15*a*, and the plurality of measuring units 15*a* may be operated at different times to improve the efficiency of measurement.

The shredded pieces of the slit piece S fed from the shredding unit 95 are merged and mixed with the raw material C fed from the quantitative feeder unit 15 in the confluence portion 17. The slit piece S and the shredding unit 95 will be described later. The raw material C with which the shredded pieces have been mixed flows into the pipe 21 from the confluence portion 17.

The pipe 21 transports the raw material C from the first unit group 101 to the second unit group 102 by using an airflow generated by a blower, which is not illustrated.

The second unit group 102 includes a defibration unit 31, a separating unit 32, a pipe 23, a mixing unit 33, and the pipe 24. In the second unit group 102, these components are disposed in this order from upstream to downstream. The second unit group 102 further includes a pipe 25 to be coupled to the separating unit 32, a collection unit 35, a compressor 38, and a power supply unit 39.

The raw material C having been transported through the pipe 21 flows into the defibration unit 31. The defibration unit 31 defibrates the raw material C fed from the quantitative feeder unit 15 into fibers in a dry process. A known defibration mechanism is applicable to the defibration unit 31.

An example of the structure of the defibration unit 31 will be described below. The defibration unit 31 includes a stator and a rotor. The stator has a substantially cylindrical inner surface. The rotor is installed inside the stator and rotates along the inner surface of the stator. A strip of the raw material C is sandwiched between the inner surface of the stator and the rotor and defibrated by a shearing force generated therebetween. As a result, tangled fibers contained in a slip of paper are defibrated into a fibrous raw material C. The fibrous raw material C is transported to the separating unit 32.

Since the defibration unit 31 physically defibrates fibers by applying a shearing force or the like, vibration is likely to occur regardless of the structure described above. On the other hand, since the sheet manufacturing apparatus 1 has a frame structure described later, the vibration is less likely to affect the measuring unit 15*a*.

The separating unit 32 removes the constituents of the fibrous raw material C that are not required to manufacture the sheet P3. Specifically, the separating unit 32 separates relatively long fibers from relatively short fibers. Since relatively short fibers may lead to a reduction in the strength of the sheet P3, relatively short fibers are separated by the separating unit 32. In addition, the separating unit 32 separates and eliminates coloring materials and additives contained in used paper. A known technology, such as a disk mesh method, is applicable to the separating unit 32.

Humidified air is supplied into the separating unit 32 from the second humidification unit 66 of the third unit group 103.

Relatively short fibers and the like are eliminated from the raw material C, and the raw material C is transported to the mixing unit 33 via the pipe 23. Unnecessary constituents, such as relatively short fibers and coloring materials, are discharged to the collection unit 35 via the pipe 25.

The mixing unit 33 mixes a binder and the like with the raw material C in air to form a mixture. Although not illustrated, the mixing unit 33 includes a flow path through which the raw material C is transported, a fan, a hopper, a feeding pipe, and a valve.

The hopper communicates with the flow path for the raw material C via the feeding pipe. The valve is provided in a feeding pipe part between the hopper and the flow path. The hopper feeds a binder, such as starch, into the flow path. The valve adjusts the mass of the binder fed to the flow path by the hopper. As a result, the mixing ratio between the raw material C and the binder is adjusted.

The mixing unit 33 may have similar components for feeding coloring materials, additives, and the like in addition to the components described above for feeding the binder.

The fan for the mixing unit 33 mixes the binder and the like with the raw material C in air while transporting the raw material C downstream by using a generated airflow to form a mixture. The mixture flows into the pipe 24 from the mixing unit 33.

The collection unit 35 includes a filter, which is not illustrated. The filter filters out the unnecessary constituents of the raw material C transported by the airflow through the pipe 25.

The compressor 38 generates compressed air. The filter described above may become clogged by fine particles or the like of the unnecessary constituents. The filter can be cleaned by blowing the compressed air generated by the compressor 38 onto the filter and blowing off the attached particles.

The compressor 38 is likely to cause vibration because the compressor 38 generates the compressed air by a reciprocating motion or the like. On the other hand, since the sheet manufacturing apparatus 1 has a frame structure, described later, the vibration described above is less likely to affect the measuring unit 15*a*.

Here, the compressor 38 may be placed on the floor, on which the sheet manufacturing apparatus 1 may also be installed, without being fixed to the second frame described later. Even in this case, the compressor 38 is coupled to other components via the pipe for compressed air or the like. Accordingly, since the vibration may propagate, the frame structure according to the embodiment is useful.

The power supply unit 39 includes, in addition to the control unit described above, a power supply device that supplies electric power to the sheet manufacturing apparatus 1. The power supply unit 39 distributes electric power supplied from the outside to individual components of the sheet manufacturing apparatus 1.

The third unit group 103 deposits and compresses the mixture containing fibers and forms the belt-like sheet P1. The third unit group 103 is an example of the sheet forming unit according to the present disclosure.

The third unit group 103 includes a depositing unit 50, a first transport unit 61, a second transport unit 62, a first humidification unit 65, a second humidification unit 66, and a forming unit 70. In the third unit group 103, the depositing unit 50, the first transport unit 61, the second transport unit 62, the first humidification unit 65, and the forming unit 70 are disposed from upstream to downstream in this order.

The depositing unit 50 produces the web W by depositing the mixture in air. The depositing unit 50 includes a drum member 53, a blade member 55 installed in the drum member 53, a housing 51 that houses the drum member 53, and a suction unit 59. The mixture is taken into the drum member 53 through the pipe 24.

The first transport unit 61 is disposed below the depositing unit 50. The first transport unit 61 includes a mesh belt 61*a* and five stretching rollers (not illustrated) over which the mesh belt 61*a* is stretched. The suction unit 59 faces the drum member 53 across the mesh belt 61*a* in the direction parallel to the Z-axis.

The blade member 55 is present inside the drum member 53 and is rotationally driven by a motor, which is not illustrated. The drum member 53 is a semi-cylindrical sieve. The side surface of the drum member 53 that faces downward is provided with a mesh having the function of a sieve. The drum member 53 allows particles of fibers, a mixture, and the like that are smaller than the size of sieve mesh openings to pass from the inside to the outside.

The mixture is ejected to the outside of the drum member 53 while being stirred by the rotating blade member 55 within the drum member 53. Humidified air is supplied into the drum member 53 from the second humidification unit 66.

The suction unit 59 is disposed below the drum member 53. The suction unit 59 sucks air in the housing 51 through a plurality of holes of the mesh belt 61*a*. Air passes through the holes of the mesh belt 61*a*, while fibers, binders, and the like contained in the mixture do not pass therethrough. As a result, the mixture released to the outside of the drum member 53 is sucked downward together with air. The suction unit 59 is a known suction device, such as a blower.

The mixture is distributed into the air in the housing 51 and deposited onto the upper surface of the mesh belt 61*a* by gravity and the suction of the suction unit 59 and becomes the web W.

The mesh belt 61*a* is an endless belt stretched over the five stretching rollers. The mesh belt 61*a* moves counterclockwise in FIG. 1 due to the rotation of the stretching rollers. As a result, the mixture is successively accumulated on the mesh belt 61*a*, and the web W is formed. The web W contains a relatively large amount of air and is softly inflated. In the first transport unit 61, the formed web W is transported downstream by the movement of the mesh belt 61*a*.

The second transport unit 62 transports the web W instead of the first transport unit 61 at a position downstream of the first transport unit 61. The second transport unit 62 peels the web W from the upper surface of the mesh belt 61*a* and transports the peeled web W toward the forming unit 70. The second transport unit 62 is located above the transport route of the web W and disposed slightly upstream of the starting point on the return side of the mesh belt 61*a*. A second transport unit 62 part that extends in the +Y direction and a mesh belt 61*a* part that extends in the −Y direction partially overlap each other in the vertical direction.

The second transport unit 62 includes a conveyor belt, which is not illustrated, a plurality of rollers, and a suction mechanism. The conveyor belt has a plurality of holes through which air passes. The conveyor belt is stretched over the plurality of rollers and moved by the rotation of the rollers.

The second transport unit 62 causes the upper surface of the web W to be sucked onto the lower surface of the conveyor belt by using a negative pressure generated by the suction mechanism. When the conveyor belt moves in this state, the web W is sucked onto the conveyor belt and transported downstream.

The first humidification unit 65 is an ultrasonic humidifier and supplies mist M, from below, to the web W transported by the second transport unit 62 to humidify the web W. The first humidification unit 65 is disposed below the second transport unit 62 and faces the web W transported by the second transport unit 62 in a direction parallel to the Z-axis.

When the web W is humidified by the mist M, the function of starch as a binder is promoted, and the strength of the sheet P3 is improved. In addition, since the web W is humidified from below, droplets derived from the mist are prevented from falling onto the web W. Furthermore, since the humidification is performed from the side opposite to the contact surface between the conveyor belt and the web W, the web W is suppressed from sticking to the conveyor belt. The second transport unit 62 transports the web W to the forming unit 70.

The forming unit 70 heats and pressurizes the web W to form the belt-like sheet P1. The forming unit 70 includes a pair of heating rollers 71 and 72. Each of the heating rollers 71 and 72 incorporates an electric heater and has a function of heating the roller surface.

The web W is pressed while being heated by being continuously passed between the pair of heating rollers 71 and 72. This reduces air contained in the soft web W that contains a relatively large amount of air, binds fibers together by using a binder, and forms the belt-like sheet P1. The belt-like sheet P1 is transported to the first unit group 101 by transport rollers, which are not illustrated.

The second humidification unit 66 is disposed below the first humidification unit 65. The second humidification unit 66 is an evaporative humidifier. The second humidification unit 66 supplies humidified air into the buffer tank 13, the separating unit 32, and the drum member 53 via a plurality of pipes, which are not illustrated. In each of the components described above, the humidified air suppresses fibers, particles, and the like of the raw material C from being charged with electricity and from adhering due to static electricity.

The belt-like sheet P1 transported to the first unit group 101 reaches the first cutting unit 81. The first cutting unit 81 cuts the belt-like sheet P1 in a direction intersecting the transport direction, for example, in a direction parallel to the X-axis. The belt-like sheet P1 is cut into a cut-form sheet P2 by the first cutting unit 81. The cut-form sheet P2 is transported from the first cutting unit 81 to the second cutting unit 82.

The second cutting unit 82 cuts the cut-form sheet P2 in the transport direction, for example, in a direction parallel to the Y-axis. Specifically, the second cutting unit 82 cuts the vicinity of both sides in the direction parallel to the X-axis of the cut-form sheet P2. As a result, the cut-form sheet P2 becomes the sheet P3 having a predetermined shape, such as A4 or A3 size. The sheet P3 is transported obliquely upward and stacked on the tray 91. The sheet P3 is applicable as a replacement for, for example, copy paper.

When the second cutting unit 82 cuts the cut-form sheet P2 into the sheet P3, the slit piece S, which is an offcut, is generated. The slit piece S is transported substantially in the −Y direction and reaches the shredding unit 95, which is a shredder. The shredding unit 95 shreds the slit piece S and feeds the shredded pieces to the confluence portion 17. A mechanism for measuring the mass of the shredded pieces of the slit piece S and feeding the measured shredded pieces to the confluence portion 17 may be installed between the shredding unit 95 and the confluence portion 17.

Figure 2:
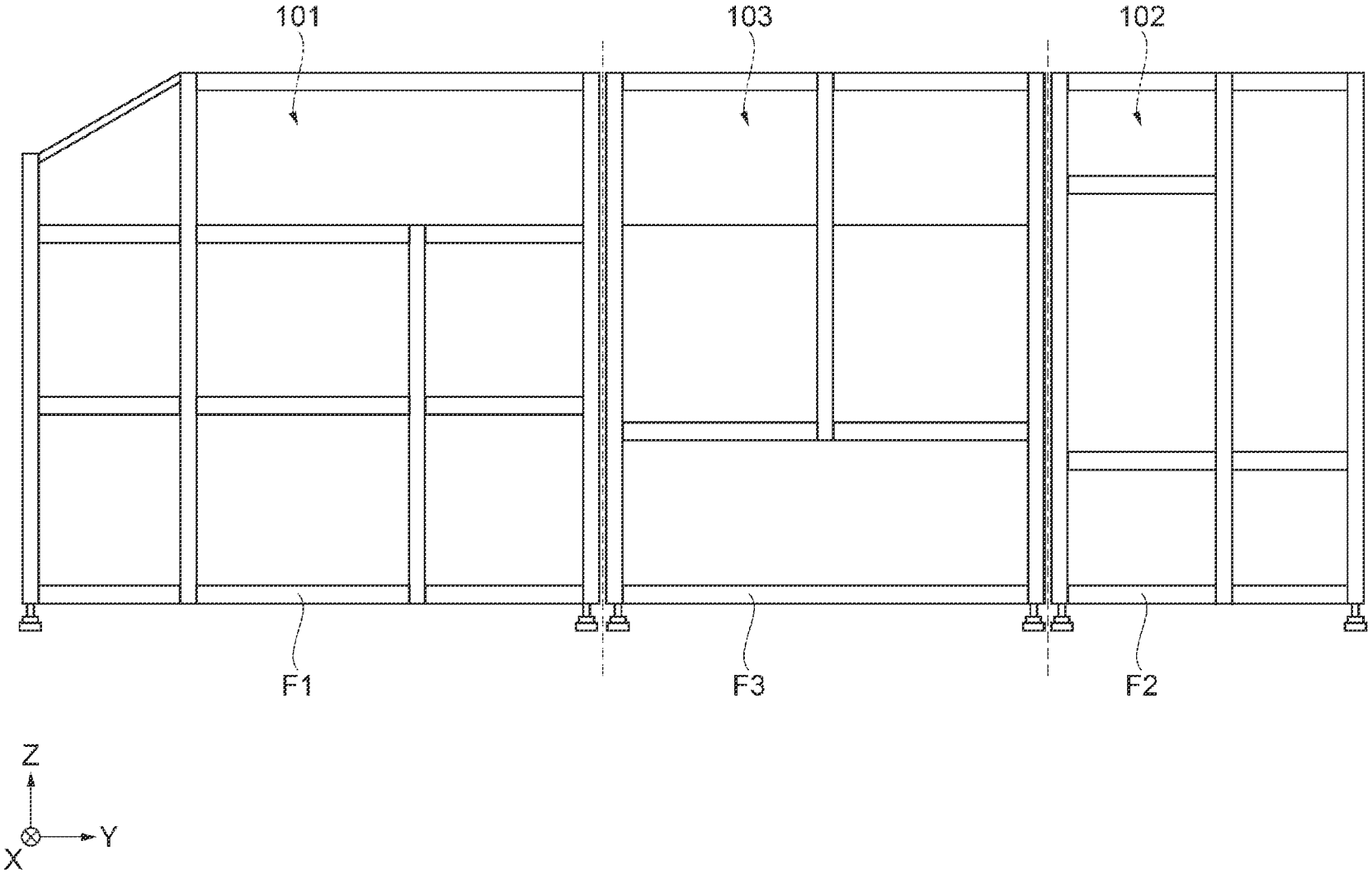
FIG. 2 is a side view illustrating the forms of a first frame, a second frame, and a third frame.
Figure 3:
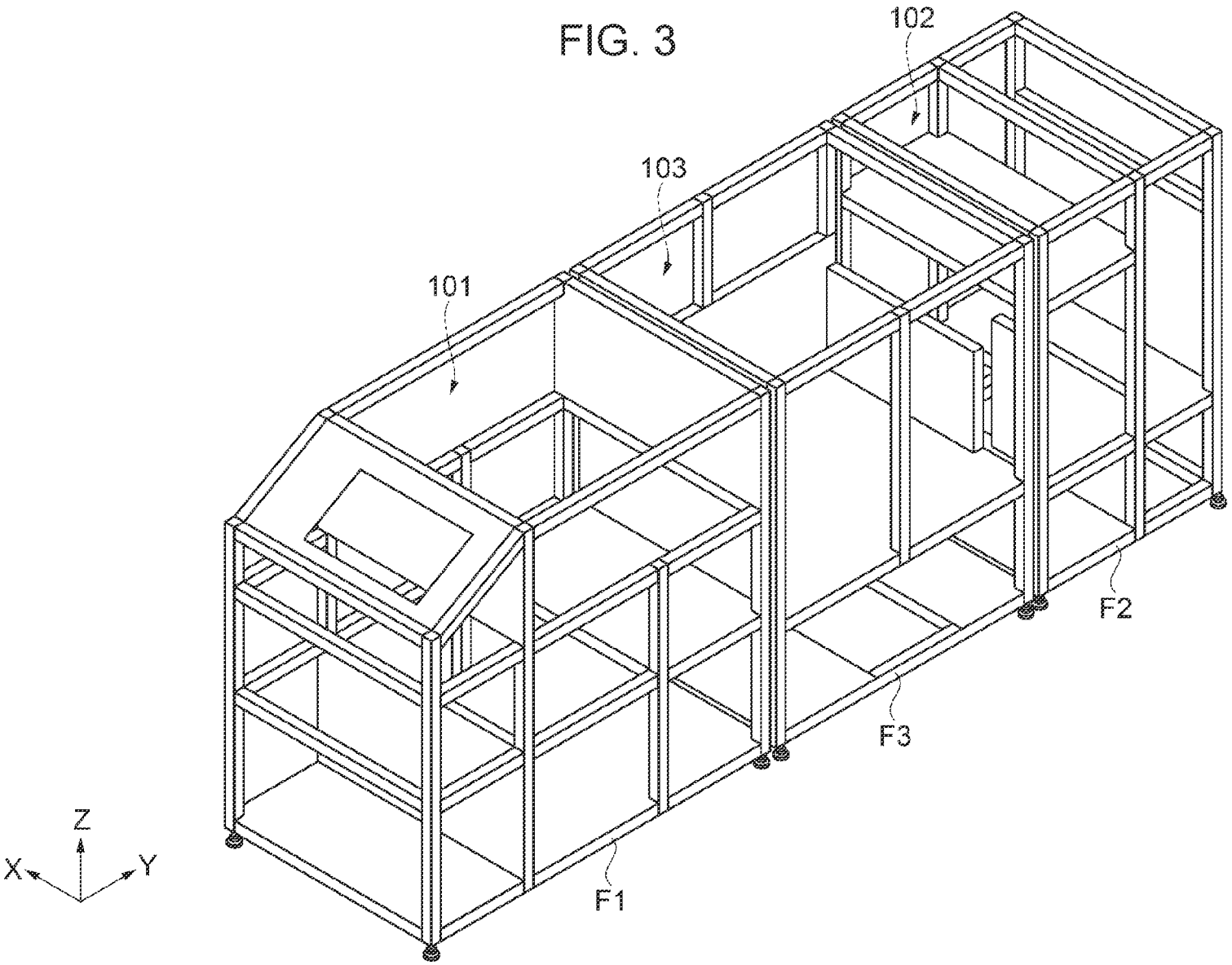
FIG. 3 is a perspective view illustrating the forms of the first frame, the second frame, and the third frame.

As illustrated in FIGS. 2 and 3, a first frame F1, a third frame F3, and a second frame F2 are arranged in this order in the Y-axis direction. The first frame F1, the second frame F2, and the third frame F3 are individual objects. The first frame F1, the second frame F2, and the third frame F3 are separated from each other. Although not illustrated, the sheet manufacturing apparatus 1 has a cabinet that covers the first frame F1, the second frame F2, and the third frame F3. It should be noted that, in FIG. 2, the boundaries between the first frame F1, the second frame F2, and the third frame F3 are indicated by dashed lines.

The third frame F3 is installed between the first frame F1 and the second frame F2. It should be noted that the first frame F1 and the third frame F3 may be linked to each other, and the third frame F3 and the second frame F2 may be linked to each other.

Each of the first frame F1, the second frame F2, and the third frame F3 includes a main frame disposed parallel to one of the X-, Y-, and Z-axes, a reinforcing member, and the like and has a space in which the components described above can be installed. Each of the first frame F1, the second frame F2, and the third frame F3 has a substantially rectangular parallelepiped outer shape. In the outlines of these frames, the lengths parallel to the X-axis are identical to each other and the heights parallel to the Z-axis are substantially identical to each other. Each of the first frame F1, the second frame F2, and the third frame F3 may have casters for movement at the lower ends.

The first unit group 101 is installed in the first frame F1. That is, the quantitative feeder unit 15 is fixed to first frame F1. The second unit group 102 is installed in the second frame F2. That is, the defibration unit 31 is fixed to second frame F2. The third unit group 103 is installed in the third frame F3. That is, the third unit group 103, which is the sheet forming unit, is fixed to the third frame F3.

According to the embodiment, the following effects can be obtained.

The measurement accuracy for the raw material C can be improved. Specifically, the first frame F1 to which the quantitative feeder unit 15 is fixed and the second frame F2 to which the defibration unit 31 is fixed are separated from each other as individual objects. Accordingly, the vibration generated by the defibration unit 31 is likely to be attenuated while propagating to the quantitative feeder unit 15. As a result, the vibration described above does not easily affect the quantitative feeder unit 15. Therefore, it is possible to provide the sheet manufacturing apparatus 1 having a high measurement accuracy for the raw material C.

Since the third frame F3 is present between the first frame F1 and the second frame F2, the distance between the first frame F1 and the second frame F2 is increased. Accordingly, the vibration that is generated by the defibration unit 31 and the compressor 38 and propagates to the quantitative feeder unit 15 is more likely to be attenuated. As a result, the measurement accuracy for the raw material C can be further improved.

What is claimed is:

1. A sheet manufacturing apparatus for manufacturing a sheet comprising:

a quantitative feeder unit including a physical sensor or a balance that measures a predetermined amount of a raw material and a vibratory feeder that feeds the measured raw material;

a defibration unit that includes a stator and a rotor and that defibrates the raw material fed from the quantitative feeder unit;

a separator that separates fibers from the defibrated raw material by removing constituents that are not required to manufacture the sheet;

a filter that filters out the constituents;

a compressor that generates compressed air and cleans the filter by blowing the compressed air to the filter;

a sheet forming unit including a belt on which the fibers are deposited and a pair of rollers that compresses the fibers that have been deposited to form the fibers into a sheet;

a first frame to which the quantitative feeder unit is fixed; and a second frame that is separated from the first frame, to which the defibration unit is fixed, and in which the separator, the filter, and the compressor are installed.

2. The sheet manufacturing apparatus according to claim 1, further comprising:

a third frame to which the sheet forming unit is fixed, wherein the third frame is installed between the first frame and the second frame.

* * * * *